US011505988B2

(12) United States Patent
Husseck et al.

(10) Patent No.: US 11,505,988 B2
(45) Date of Patent: Nov. 22, 2022

(54) CLIMATE CHAMBER

(71) Applicant: Binder GmbH, Tuttlingen (DE)

(72) Inventors: Mario Husseck, Villingen-Schwenningen (DE); Nina Seligmann, Deisslingen (DE); Jan Moll, Donaueschingen (DE)

(73) Assignee: Binder GmbH, Tuttlingen (DE)

( * ) Notice: Subject to any disclaimer, the term of this patent is extended or adjusted under 35 U.S.C. 154(b) by 0 days.

(21) Appl. No.: 17/098,899

(22) Filed: Nov. 16, 2020

(65) Prior Publication Data

US 2021/0148161 A1 May 20, 2021

(30) Foreign Application Priority Data

Nov. 15, 2019 (DE) ..... 10 2019 130 848.8

(51) Int. Cl.
*E06B 5/00* (2006.01)
*E06B 3/70* (2006.01)

(52) U.S. Cl.
CPC ..... *E06B 5/00* (2013.01); *E06B 3/7015* (2013.01); *E06B 2003/708* (2013.01); *E06B 2003/7023* (2013.01); *E06B 2003/7051* (2013.01); *E06B 2003/7074* (2013.01)

(58) Field of Classification Search
CPC . E06B 5/00; E06B 5/16; E06B 3/7015; E06B 2003/7023; E06B 2003/7051; E06B 2003/7074; E06B 2003/708
USPC ..... 52/784.1
See application file for complete search history.

(56) References Cited

U.S. PATENT DOCUMENTS 5,533,311 A * 7/1996 Tirrell ..... E06B 7/2312 49/501
10,407,976 B1 * 9/2019 Kelley ..... E06B 3/7015
11,009,284 B2 * 5/2021 Allard ..... B29C 70/70
(Continued)

FOREIGN PATENT DOCUMENTS

CN 105190207 A 12/2015
EP 3822562 A1 * 5/2021 ..... E06B 3/7015
KR 101830091 3/2018
(Continued)

OTHER PUBLICATIONS

German Patent Office, "Examination Report," and English translation thereof, issued in German Patent Application No. 10 2019 130 848.8, dated Jul. 29, 2020, document of 16 pages.
(Continued)

*Primary Examiner* — Beth A Stephan
(74) *Attorney, Agent, or Firm* — Akerman LLP; Peter A. Chiabotti

(57) ABSTRACT

The present application discloses a climate chamber comprising at least one housing comprising a door, with an interior volume which is closable with the at least one door, wherein the at least one door comprises an inner wall and an outer wall, wherein the inner wall is formed of a unitary and bendable base body which comprises a polygonal wall section enclosed by side regions, wherein from each of the side regions projects a tongue with its free end, wherein the tongue in a first edge is canted from the wall section into a first section to form a tray and wherein the free end of the tongue is canted back by a second edge into a second section in order to form a sealing seat into which a sealing can be set.

14 Claims, 3 Drawing Sheets

(56) References Cited

U.S. PATENT DOCUMENTS

| | | | |
|---|---|---|---|
| 2004/0177591 | A1 | 9/2004 | Avendano et al. |
| 2006/0248824 | A1 | 11/2006 | Cho et al. |

FOREIGN PATENT DOCUMENTS

| | | | |
|---|---|---|---|
| WO | 2014095528 | A1 | 6/2014 |
| WO | 2018/163365 | | 9/2018 |

OTHER PUBLICATIONS

Binder GmbH, "Service Instructions KBF + KMF (E6). Version Feb. 2019" and English translation of of the pages cited in the German Examination Report, Tuttlingen, 2019, document of 125 pages.

Binder GmbH, KBF + KMF Operating Instructions (E6), Version Oct. 2017, and English translation thereof, Tuttlingen, 2017, document of 314 pages.

European Patent Office, "European Supplemental Search Report" issued in European Patent Application No. 20205596.8, dated Apr. 8, 2021, document of 2 pages, with references characterized as X or Y.

The State Intellectual Property Office of People's Republic of China, "Office Action" issued in Chinese patent Application No. 202011247223, dated Dec. 31, 2021, document of 15 pages.

* cited by examiner

CLIMATE CHAMBER

CROSS-REFERENCE TO RELATED APPLICATIONS

This application claims priority to German Patent Application No. 10 2019 130 848.8, filed Nov. 15, 2019, which is incorporated by reference in its entirety.

BACKGROUND

The application relates to a climate chamber with at least one housing comprising a door and with an interior volume that is closable with the at least one door.

SUMMARY

Prior art climate chambers are known in various implementations and are employed in scientific laboratories or in the industry to simulate biological, chemical and/or physical environmental conditions such as, for example temperature, atmospheric pressure and/or humidity. A climate chamber comprises an interior volume and a housing, wherein the interior volume is disposed within the housing and the biological, chemical and/or physical environmental conditions are simulated within the interior volume.

The doors of the climate chambers enable not only physical access to the interior volume but, its walls must also comprise thermal insulation in order to thermally decouple the interior volume from the environment. Climate chambers can typically set temperatures between −10° and 100°. However, there are also climate chambers for the high-temperature range which can permanently set temperatures of up to 350° in the interior volume. Herein doors must have sufficient insulation, for one, and furthermore seal the door reveal tightly so that, apart from the exchange of heat with the environment, the exchange of material is also prevented. For this purpose, sealing must be provided in the door or on the housing.

The disadvantage of the doors disclosed in prior art has been found to be that the construction of the door of a climate chamber is complex, time-consuming and resource-intensive.

The present application therefore addresses the problem of providing a climate chamber with an improved door which appropriately addresses the problem of improving the doors known in prior art, simplifies the production process and, due to the improved processes, contributes to cost reduction.

These problems are resolved through a climate chamber with the features disclosed herein.

The climate chamber comprises at least one housing having a door, with an interior volume that can be closed with the at least one door. The at least one door comprises an inner wall and an outer wall, wherein the inner wall is shaped of a unitary and flexible base body that comprises a polygonal wall section enclosed by side regions. From each of the side regions projects a tongue with a free end, wherein the particular tongue is bent, preferably by 90°, in a first edge for the formation of a tray from the wall section, to a first section from the wall section. To develop a sealing seat into which a sealing can be set to lock a door reveal between door and housing, a second edge is provided which toward the free end of the tongue is canted back into a second section of the first section on the side, facing away from the wall section, of the first section.

The application is based on the concept of producing the inner wall from a single piece—preferably by bending—, wherein the discrete edges of the inner wall are formed into the base body in a computerized numerically controlled (CNC) production process. A tray for receiving one or more thermally insulating layers on the side facing an outer side as well as a sealing seat for the door sealing on a side facing the inner side are provided. The number of utilized structural elements for the production of a door of a climate chamber can be significantly reduced, the production steps can be automated to a high degree whereby the process reliability can be raised and cost savings can be achieved.

By side regions of the polygonal wall section are understood those regions that are developed along a straight connection line between the corners of the wall section.

In a preferred further development, the polygonal wall section is shaped rectangularly and consequently has four corners and four side regions. Two adjacent side regions preferably form an angle of 90° at a corner.

The particular tongue projects freely from each side region and preferably has a constant length which corresponds to the length of the particular side region. The particular length is measured parallel to the first edge or parallel to the associated side region. The width of the particular tongue, measured perpendicularly to the first edge, preferably corresponds at least to the twofold depth of the door. All of the tongues can be of the same width, while the length is predetermined by the form of the door. The tongues can correspondingly be developed orthogonally.

According to a further advantageous implementation, the second edge is canted such that the second section is approximately parallel to the first section and consequently perpendicular to the wall section. The two sections form a strong and rugged tray in which the at least one filling or insulating layer can be retained. This configuration of the first section and of the second section, moreover, reinforces the door.

According to a preferred further development, a third edge and a fourth edge are provided. The third edge bends toward the free end of the tongue a third section at an angle from the second section and the fourth edge bends toward the free end of the tongue a fourth section at an angle from the third section.

It is preferred for a distance between the first edge and the second edge to be greater than a distance between the second edge and the third edge, whereby the third edge is positioned on a side of the wall section on which the second edge is also disposed.

In addition, it has been found to be advantageous if the sealing seat is U-shaped in cross section and that the sealing seat in regions is developed out of the first section, out of the third section and out of the fourth section.

At the third edge the third section is bent at an angle from the second section such that a bottom is formed for the sealing seat which is oriented approximately parallel to the wall section.

It is furthermore preferred for the fourth section to be disposed approximately parallel to the first section and/or the second section, whereby the cross section of the sealing seat is approximately orthogonal.

An advantageous further development provides that a first edge is provided which forms toward the free end of the tongue an end section that is disposed parallel to the wall section and is preferably aligned with the wall section. The end section is configured such that it rests on the outer wall or overlaps the outer wall and forms the transition between the inner wall and the outer wall.

It is moreover advantageous if the first distance between the first edge and the second edge is less than the sum of the second distance between the second edge and the third edge and of a fourth distance between the fourth edge and the fifth edge, wherein the distances in each case are measured parallel to the first section. Due to this dimensioning of the distances, it is ensured that in the mounted state of the door no static overdetermination arises and that the filling is retained under form closure in the tray between the outer wall and the inner wall.

According to a further implementation, securement means are provided in the sealing seat, wherein the securement means are preferably configured to establish a connection between the inner wall and the outer wall. In particular, it is preferred for the securement means to be disposed in the third section, thus in the bottom of the sealing seat, and, further preferred, that it comprises threaded fasteners. As soon as the sealing has been set into the sealing seat, the securement means are concealed by the sealing and are no longer visible. The sealing also prevents contaminations from penetrating into the sealing seat and reach the securement means.

It has furthermore been found to be advantageous if the first section and the second section are connected with one another by connection means. It is in particular preferred for the connection means to be disposed in the first section between the first edge and the second edge and in each case spaced apart from these edges, wherein the distance between the first edge is preferably less than the distance from the second edge. The intention here is to prevent the sealing seat from bending open. The connection means are preferably developed of rivets or spot weldings. However, other connection means can also be applied.

In the tray a filling can also be disposed which is preferably produced of a synthetic rigid foam. Such a rigid foam can, for example, be a PUR or PIR foam that is known for its high thermal resistivity. The filling can be produced of prefabricated plates which can, furthermore, be secured by means of temperature-stable adhesive. The filling can also be produced of multi-layered and/or of different materials in order to provide an insulation and temperature stability that is matched as best as possible to the corresponding temperature range of the climate chamber. Alternatively, the tray can be filled with foam after the door has been mounted wherein simultaneously an extremely robust adhesive connection between the inner wall and the outer wall can be accomplished.

According to a further preferred implementation, the inner wall and/or the outer wall is or are produced of a special steel. Special steel has been found to be useful for walls in simulation chambers since this material has a thermally, chemically as well as also a mechanically stable and resistant surface.

The outer wall and the inner wall are preferably generated by bending an appropriately formed base body, wherein the base body can be provided as a stamped part by stamping.

BRIEF DESCRIPTION OF DRAWINGS

In the following an embodiment example will be described in detail in conjunction with the accompanying drawing. Therein depict.

DETAILED DESCRIPTION

In the following identical or functionally identical parts are identified by same reference symbols. For the sake of clarity, in the discrete Figures not all identical or functionally identical components are provided with a reference number.

Figure 1:
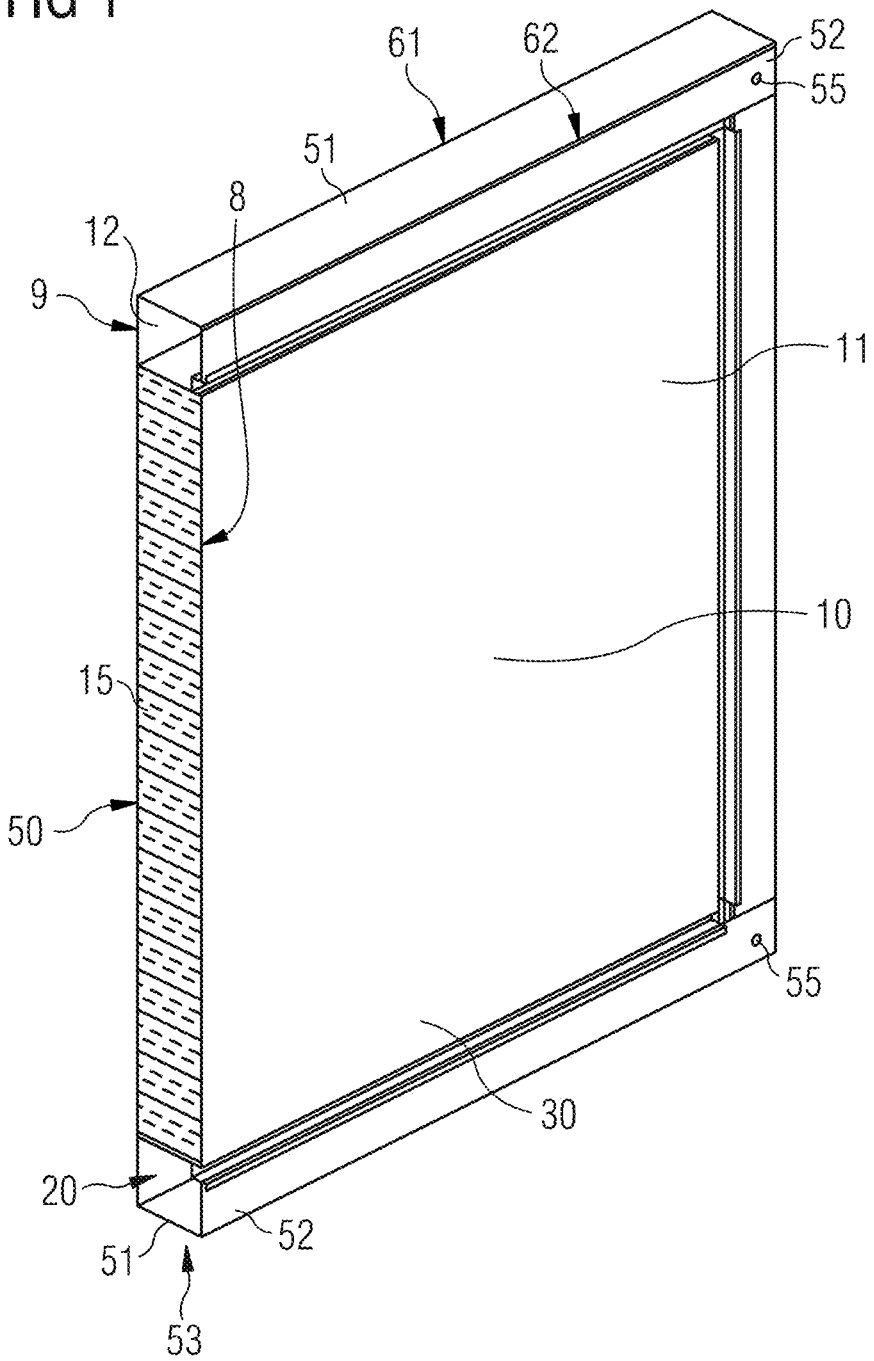
FIG. 1: a perspective representation of a door of a climate chamber with an outer wall and an inner wall.

In FIG. 1 a door 10 of a not completely depicted climate chamber 1 [sic: chamber 1 is not indicated by reference number] is shown with which a (not depicted) housing of a climate chamber 1 can be closed. The door 10 comprises an inner side 8 and an outer side 9, wherein the inner side 8 is facing the interior volume and the outer side 9 is facing the environment.

The door 10 comprises an inner wall 11 and an outer wall 12 that can each be preferably produced of a plate-shaped and bendable base body. The plate-shaped and bendable base body can be produced of a special steel sheet and—as will be described in the following in detail—can comprise several edges 21, 22, 23, 24, 25, 61, 62 that can be produced by bending, in particular by CNC bending.

The outer wall 12 substantially forms a wall disposed on the outer side 9 of the door 10 and comprises an orthogonal front side section 50 on whose sides are disposed a first frame section 51 and second frame section 52 that form a frame 53 for receiving the inner wall 11.

The first frame section 51 projects with a first edge 61 at an angle perpendicularly from the front side section 50 in the direction toward the inner side 8 and forms the side wall of door 10. The second frame section 52 is developed parallel to the front side section 50 and, by means of a second edge 62, bent at an angle [perpendicularly] from the first frame section 51 and connected by it with the front side section 50. The first edge 61 and the second edge 62 are oriented in parallel and spaced apart.

Figure 2:
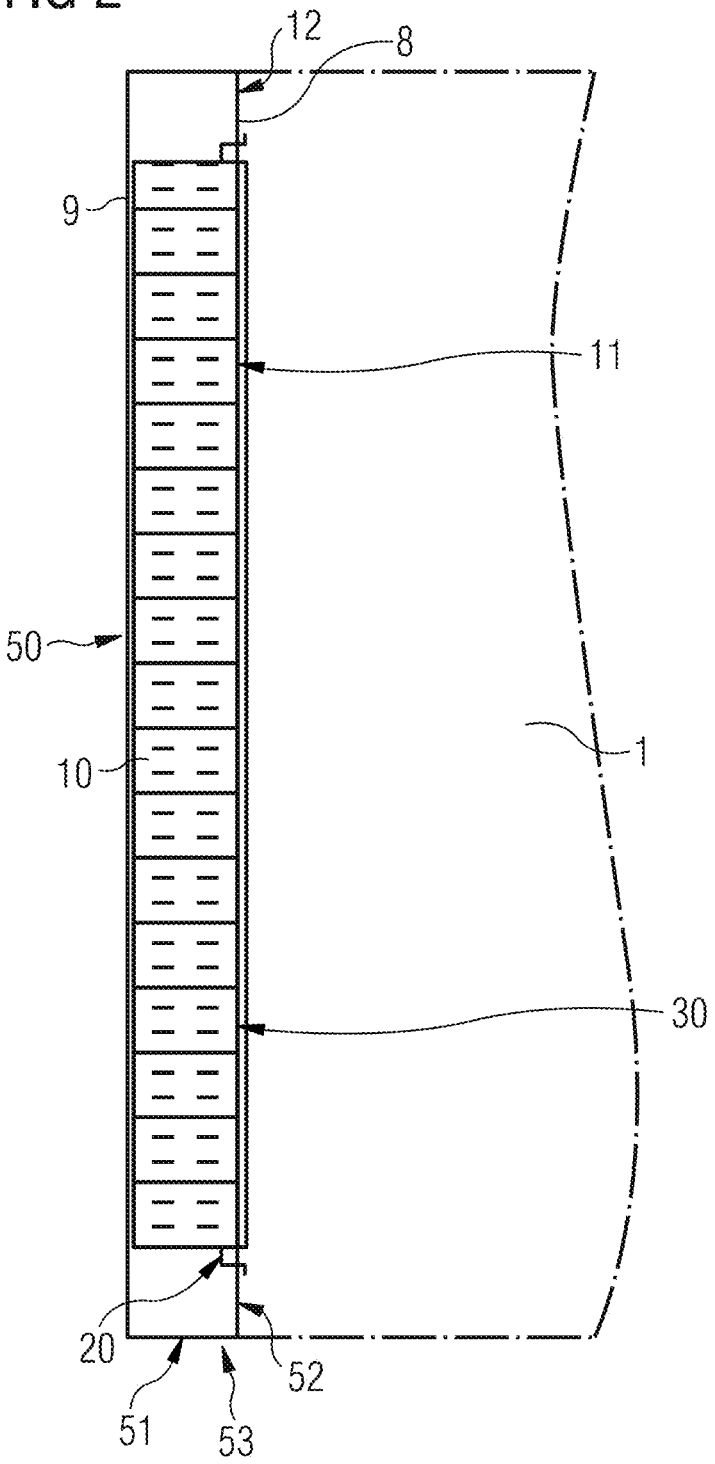
FIG. 2: an enlarged and partially sectional representation of the door of the climate chamber according to FIG. 1, FIG. 3: an enlarged sectional representation of the inner wall of the door according to FIGS. 1 and 2, wherein the inner wall via several edges forms a tray and a sealing seat for a sealing.

In corner regions of the outer wall 12 are located one above the other two adjacent second frame sections 52 which can be connected with one another, in particular by rivets 55 [sic: omitted from FIG.], s. FIG. 2, to reinforce the structure.

The two frame sections 51, 52 and the front side section 50 form a pocket that is U-shaped in cross section, in which a thermally insulating material can be disposed.

Figure 3:
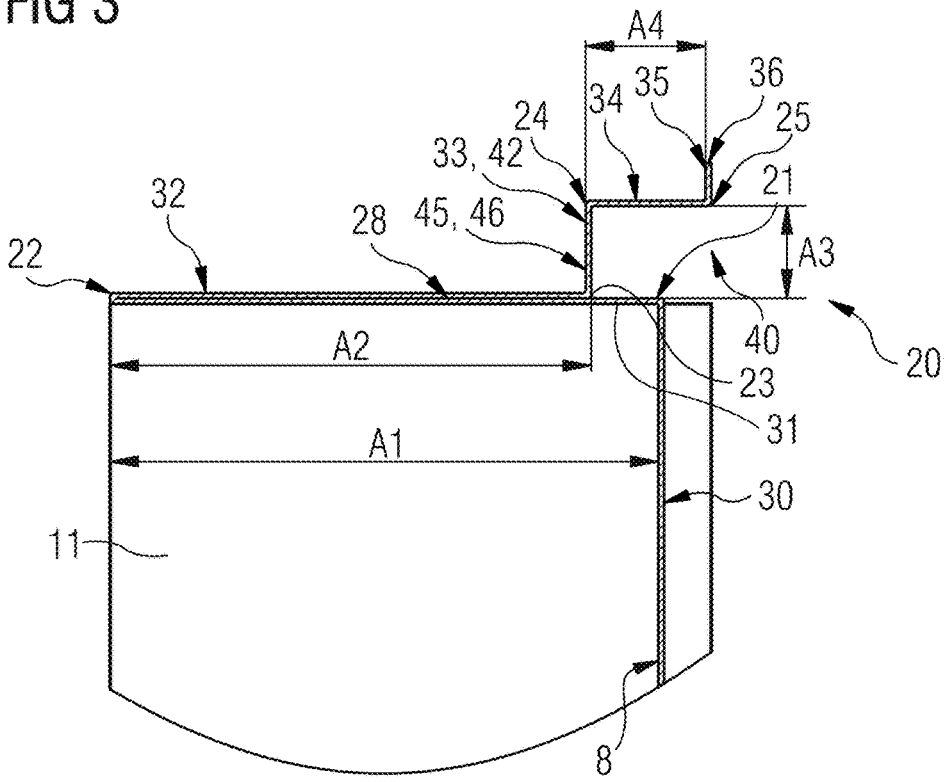
Figure 4:
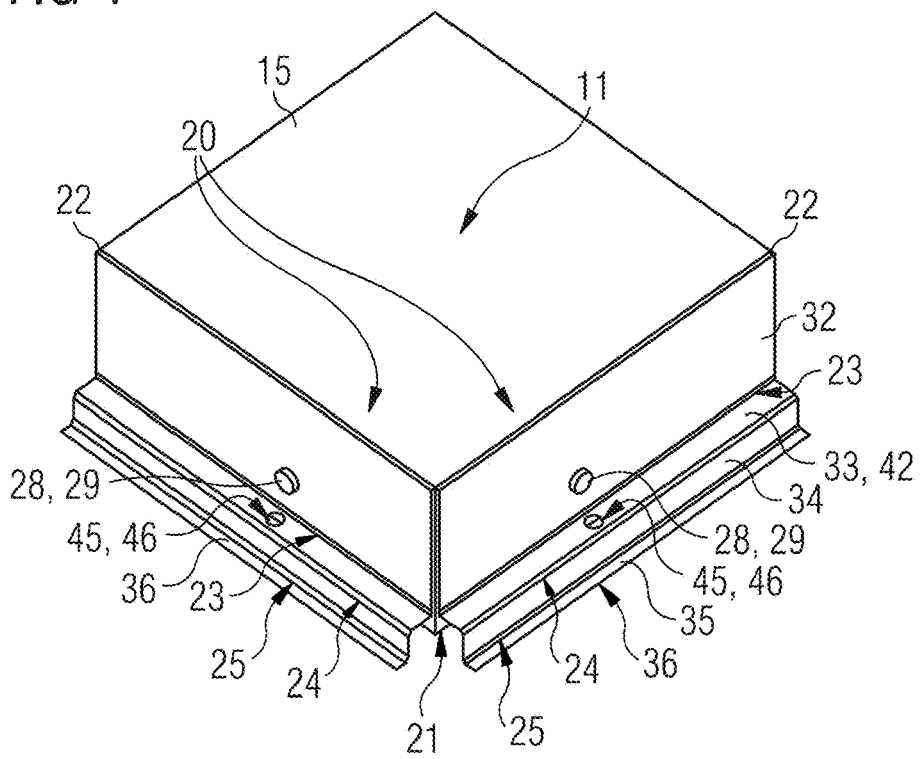
FIG. 4: an enlarged and perspective representation of the inner wall according to FIG. 3.

With reference to FIGS. 3 and 4, the inner wall 11 comprises a multiplicity of edges 21, 22, 23, 24 and 25, which can be formed by CNC bending. To produce the inner wall 11, first, the plate-shaped and bendable base body is provided. The base body can be developed in the shape of an X or a cross and comprises an orthogonal wall section 30 that is surrounded by four side regions. According to definition, the particular side region is disposed between two adjacent corners of the orthogonal wall section 30. Two adjacent side regions form a right angle at each corner.

From the wall section 30 projects freely at each side region a tongue 20 [not 53 of FIG. 2]. The particular tongue 20 preferably extends completely over the particular side region, which means the length of the side region corresponds substantially to the length of tongue 20. Tongue 20 comprises a free end 36 which is disposed parallel to and spaced apart from the side region. Correspondingly, the tongue 20 is substantially also orthogonal.

In FIG. 3 can be gathered that the inner wall 11 forms a tray 15 [not indicated by number in FIG. 3] and a sealing seat 40, wherein in the tray 15 a (not depicted) filling can be disposed. The filling can be produced of a thermally insulating material with high thermal resistivity, or low thermal conductivity λ, preferably λ<0.05 W/mK. Such a filling can be produced of a PUR material or PIR material.

The tray 15 is on the side, facing the outer side 9, of inner wall 11 formed by a first edge 21, whereby the tongue 20 is bent approximately at right angles in the direction of the outer side 9. The first edge 21 can be bent at a bending radius. On the side, facing away from the wall section 30, of the first edge 21 is developed a first section 31 [not indicated by number in any Figure] of tongue 20. The first edge 21 is developed on the side region of wall section 30.

At a first distance A1 from the first edge 21 a second edge 22 is disposed that extends parallel to and spaced apart from the first edge 21. About the second edge 22 the tongue 20 is canted back onto the side, facing away from the wall section 30, of the first section 21 [sic: 31], i.e. the tongue 20 is formed back at the second edge 22 by 180°. The second edge 22 determines the depth of the tray 15.

To facilitate the sharp-edged bending of the second edge 22, a [score] perforation 27 [not indicated by number] can be worked or formed into tongue 20 before forming the second edge 22. The perforation 27 is shown [not by number] in particular in FIGS. 3 and 4 and it is evident that narrow connection webs are developed between recesses. The recesses can be generated during the provision of the base body.

It is furthermore evident in FIG. 3 that the tongue 20 has a third edge 23 [not indicated by number], a fourth edge 24 and a fifth edge 25 [indicated in FIG. 3 as a side].

The third edge 23 is developed for forming a third section 33 on the side, facing away from the first edge 21, of the second edge 22 and parallel to the first edge 21 and parallel to the second edge 22 developed at a second distance A2 from the second edge 22. At the third edge 23 the tongue 20 is canted by 90° with a bending radius whereby the third section 33 is disposed approximately parallel to the wall section 30 and forms a bottom 42 of the sealing seat 40.

The fourth edge 24 is disposed on the side, facing away from the second edge 22, of the third edge 23 and is also disposed parallel to the second edge 22 and the third edge 23, at a third distance A3 [from the third edge 23]. The tongue [20] is also canted by approximately 90° about the fourth edge 24 and can be bent at a bending radius.

The enlarged representation according to FIG. 3 shows furthermore that the sealing seat 40 is formed in regions by the first section 31 [not indicated by number], by the third section 33 and the fourth section 34 and is substantially U-shaped in cross section.

At a fifth distance A5 [not indicated by number in FIG. 3] on the side, facing away from the third edge 23, of the fourth edge 24, the fifth edge 25 [not indicated by number in FIG. 3] is disposed parallel to edges 21, 22, 23 and 24. Through the fifth edge 25 at the free end 36 of tongue 20 is developed an end section 35 which—as can be seen in FIGS. 1 and 2—in the mounted state of the door 10 overlaps the second frame section 52 of the outer wall 12. The fifth edge 25 can also be provided with a bending radius.

Into the substantially U-shaped sealing seat 40 a (not depicted) sealing can be set. To prevent the bending open of the sealing seat 40, and consequently prevent the sealing from falling out, connection means can be provided through which the first section 31 [not indicated by number] and the second section 32 are connected with one another.

In the depicted embodiment example, between the first edge 21 and the second edge 22 in the first section 31 [not indicated in FIG. 4], as well as in the second section 32 between the second edge 22 and the third edge 23, a throughbore 28 is provided which [throughbores], after the forming of the second edge 22, are oriented in alignment with one another. Into these throughbores 28, for example, rivets 29 can be set as connection means.

The first distance A1, thus the distance between the first edge 21 and the second edge 22, is greater than the second distance A2 between the second edge 22 and the third edge 23.

The third distance A3 is determined by the width of the not depicted sealing and is dimensioned such that the sealing can be retained clamped into the sealing seat 40.

The fourth distance A4 determines the depth of the sealing seat 40 and is again determined by the sealing. The sum of the second distance A2 and of the fourth distance A4 can be dimensioned such that the sum corresponds approximately to the first distance A1. In the depicted embodiment example the end section 35 in the mounted state of the door 10 is not in contact on the second frame section [52], but rather projects on the inner side 8. In this preferred implementation the following applies: A4+A2>A1.

For the production of door 10, first, the plate-shaped and bendable base bodies are provided and preferably takes place by stamping. The inner wall 11 and the outer wall 12 are subsequently preferably reformed using CNC bending into the previously described forms.

After the reforming, first, the filling is set into the tray 15 and can here be secured by means of an adhesive. Alternatively, or supplementarily, the filling can be formed in the tray [15] by filling it with a synthetic rigid foam. The filling can also be loosely set into the tray 15.

The unit formed in this manner can subsequently be set into the frame 53 formed by the outer wall 12 until the second edge 22 is in contact on the front side section 50 of the outer wall 12, and the tray 15 is closed by the front side section 50 of the outer wall 12. The filling of the tray 15 is consequently completely enclosed.

The inner wall 11 and the outer wall 12 can be connected with one another by securement means 45. For this purpose, into the bottom 42 of the sealing seat 40 openings 46 can be formed or worked in, into which, for example (not [fully] depicted) threaded fasteners can be introduced as securement means which can engage into corresponding mating threads on the side, facing the inner wall 11, of the outer wall 12. As soon as the sealing is set into the sealing seat 40, the securement means are concealed and are no longer visible.

LIST OF REFERENCE NUMBERS

1 Climate chamber
8 Inner side
9 Outer side
10 Door
11 Inner wall
12 Outer wall
15 Tray
16 Filling
20 Tongue
21 First edge
22 Second edge
23 Third edge
24 Fourth edge

25 Fifth edge
27 Perforation
28 Throughbore
29 Rivet
30 Wall section
31 First section
32 Second section
33 Third section
34 Fourth section
35 End section
36 Free end of 20
40 Sealing seat
42 Bottom
45 Securement means
46 Opening
50 Front side section
51 First frame section
52 Second frame section
53 Frame for receiving 11
61 First edge
62 Second edge

The invention claimed is:

1. A climate chamber, comprising:

a housing comprising a door, wherein the housing has an interior volume that is closable with the door, wherein the door comprises:

an inner wall and an outer wall, wherein the inner wall is built of a unitary and bendable base body that comprises a polygonal wall section enclosed by side regions, wherein a tongue with a tongue free end projects from each side region of the side regions, wherein each tongue is canted in a first edge from the wall section into a first section for the formation of a tray, wherein the tongue free end is canted back through a second edge into a second section for the formation of a sealing seat into which a sealing can be set, wherein the inner wall forms the tray, and the tray receives a thermally insulating layer on a side facing outside of the interior volume and provides a sealing seat for the door sealing on a side facing the interior volume.

2. The climate chamber as in claim 1, wherein the wall section is developed orthogonally and each tongue projects on a corresponding side region.

3. The climate chamber as in claim 1, wherein the second edge is canted such that the second section is disposed approximately parallel to the first section.

4. The climate chamber as in one of claim 1, wherein each tongue further comprises a third edge and a fourth edge, wherein the third edge separates a third section from the second section, and wherein the fourth edge bends a fourth section at an angle from the third section.

5. The climate chamber as in claim 4, wherein a first distance (A1) between the first edge and the second edge is greater than a second distance (A2) between the second edge and the third edge.

6. The climate chamber as in claim 5, wherein the sealing seat is U-shaped in cross section and formed by the first section, by the third section and by the fourth section.

7. The climate chamber as in claim 6, wherein the third section forms a bottom of the sealing seat and is disposed approximately parallel to the wall section.

8. The climate chamber as in claim 7, wherein the fourth section is disposed approximately parallel to the first section and/or approximately parallel to the second section.

9. The climate chamber as in claim 4, further comprising a fifth edge that forms an end section disposed parallel to the wall section.

10. The climate chamber as in claim 9, wherein a first distance A1 between the first edge and the second edge is less than the sum of a second distance A2 between the second edge and the third edge and of a fourth distance A4 between the fourth edge and the fifth edge, thus $A1 \leq A2 + A4$.

11. The climate chamber as in claim 1, wherein a sealing seat securement is provided through which the inner wall is connectable with the outer wall.

12. The climate chamber as in claim 1, wherein first section is connected with the second section.

13. The climate chamber as in claim 1, wherein a synthetic cured rigid PUR or PIR foam is disposed in the tray.

14. The climate chamber as in claim 1, wherein the inner wall and/or the outer wall are steel.

* * * * *